US006453715B1

(12) United States Patent
Venäläinen

(10) Patent No.: US 6,453,715 B1
(45) Date of Patent: Sep. 24, 2002

(54) GRIPPING DEVICE FOR STRAIGHTENING A CAR BODY

(75) Inventor: Teuvo Olavi Venäläinen, Kuopio (FI)

(73) Assignee: Autorobot Finland Oy, Kuopio (FI)

( * ) Notice: Subject to any disclaimer, the term of this patent is extended or adjusted under 35 U.S.C. 154(b) by 0 days.

(21) Appl. No.: 09/698,543

(22) Filed: Oct. 27, 2000

(30) Foreign Application Priority Data

Oct. 28, 1999 (FI) ..... 992323

(51) Int. Cl.[7] ..... B21D 1/12
(52) U.S. Cl. ..... 72/308; 72/705
(58) Field of Search ..... 24/68 CD, 265 AL, 24/308; 72/422, 705; 254/133 R; 269/95, 130; 294/103.1, 119.1

(56) References Cited

U.S. PATENT DOCUMENTS 4,148,210 A * 4/1979 Bjork ..... 72/705

OTHER PUBLICATIONS

Brochure by Pull–It Corporation of Portland, Oregon entitled "Mo–Clamp" received by the PTO Aug. 1989, copy in 72/705.*

* cited by examiner

*Primary Examiner*—Lowell A. Larson
(74) *Attorney, Agent, or Firm*—Steinberg & Raskin, P.C.

(57) ABSTRACT

The present invention relates to a gripping device for straightening work of a car body, with the aid of which gripping device the target of the car body being straightened is gripped and a straightening force is directed at said gripping device with the aid of a pull tool. The gripping device comprises a frame clamping member having gripping claws which can be brought around an edge of the target of the vehicle being repaired, in order to grip the vehicle, a rotatable fastening member pivotably mounted to the frame clamping member and a pull tool, such as a chain or equivalent, whereto the pull tool is fastened, whereby the rotatable fastening member is arranged to be rotatable relative to the frame clamping member of the gripping device, wherein the range of the angle of rotation of the rotatable frame fastening member is 0 to 180 °, such that opposite pull directions are achieved.

11 Claims, 4 Drawing Sheets

GRIPPING DEVICE FOR STRAIGHTENING A CAR BODY

CROSS-REFERENCE TO RELATED APPLICATION

This application claims priority under 35 U.S.C. § 119 of Finnish patent application Ser. No. 992323 filed Oct. 28, 1999.

FIELD OF THE INVENTION

The present invention relates to a gripping device for straightening a car body.

BACKGROUND OF THE INVENTION

Fastening members of pull halters, that is, gripping devices are known in prior art to be used when a car body is straightened, with which a damaged spot in a car body, e.g. a door edge, is gripped. The straightening force created by a hydraulic cylinder is directed at the point on the vehicle to be repaired. An end of the hydraulic cylinder is fastened to a chain, and the chain further to a gripping device. The gripping device comprises two frame part halves, which by screw action are tightened relative to each other so that the fastening claws of the gripping device halves grip an edge of the target being straightened. Also known in the art is a gripping tool in which a rotatable fastening arm of the pull halter is fastened to the frame part of the gripping device. In the design known in the art said fastening arm is guided in a conductor in a groove running on the edges of the gripping device frame part, said groove comprising bearing means for enabling a rotary movement between the parts.

No satisfactory construction is provided by means of the rotation of a fastening member to a pull halter of a prior art gripping device structure. Since the point of rotation is located in the circumference on the edge of the frame part, said location of the point of rotation is not optimal relative to the frame part of the gripping device. In addition, the overall area of rotation in the prior art design is considerably below 180°, so that the opposite pull directions (0° and 180°) are not achieved.

OBJECTS AND SUMMARY OF THE INVENTION

Accordingly, it is an object of the present invention to provide new and improved gripping device for straightening a car body part.

Another object of the present invention is to provide new and improved gripping device permitting a rotary range of a pull tool is 180°.

A gripping device of novel type is disclosed in the present application in which the fastening member of a pull tool, such as a chain, is articulated to be rotatable on the center line of the frame part of the gripping device, and moreover so that it is located both in the vertical center line of the frame part of the gripping device and in the horizontal center line defined by the fastening screws. In addition, the rotation of a pull tool is implemented so that the rotary range is 180°, whereby the opposite pull directions are reached.

As taught by the invention, the structure can further comprise a second gripping member of the pull tool, whereby a rectangular pull direction relative to the above mentioned 0–80° pull plane is provided as the pull direction. Said fastening member can be detachably fastened to the frame part of the gripping device that is disposed in a recess of the frame part of the gripping device, between the rotatable fastening member and the bottom of said recess such that the frame part of the gripping device is fastened to the rotatable fastening member without any need for separate additional fastening screws for securing the fastening of the second fastening member.

BRIEF DESCRIPTION OF THE DRAWINGS

The invention is described below, reference being made to a number of advantageous embodiments of the invention presented in the figures of the accompanying drawings.

DETAILED DESCRIPTION OF THE PREFERRED EMBODIMENT

Figure 1A:
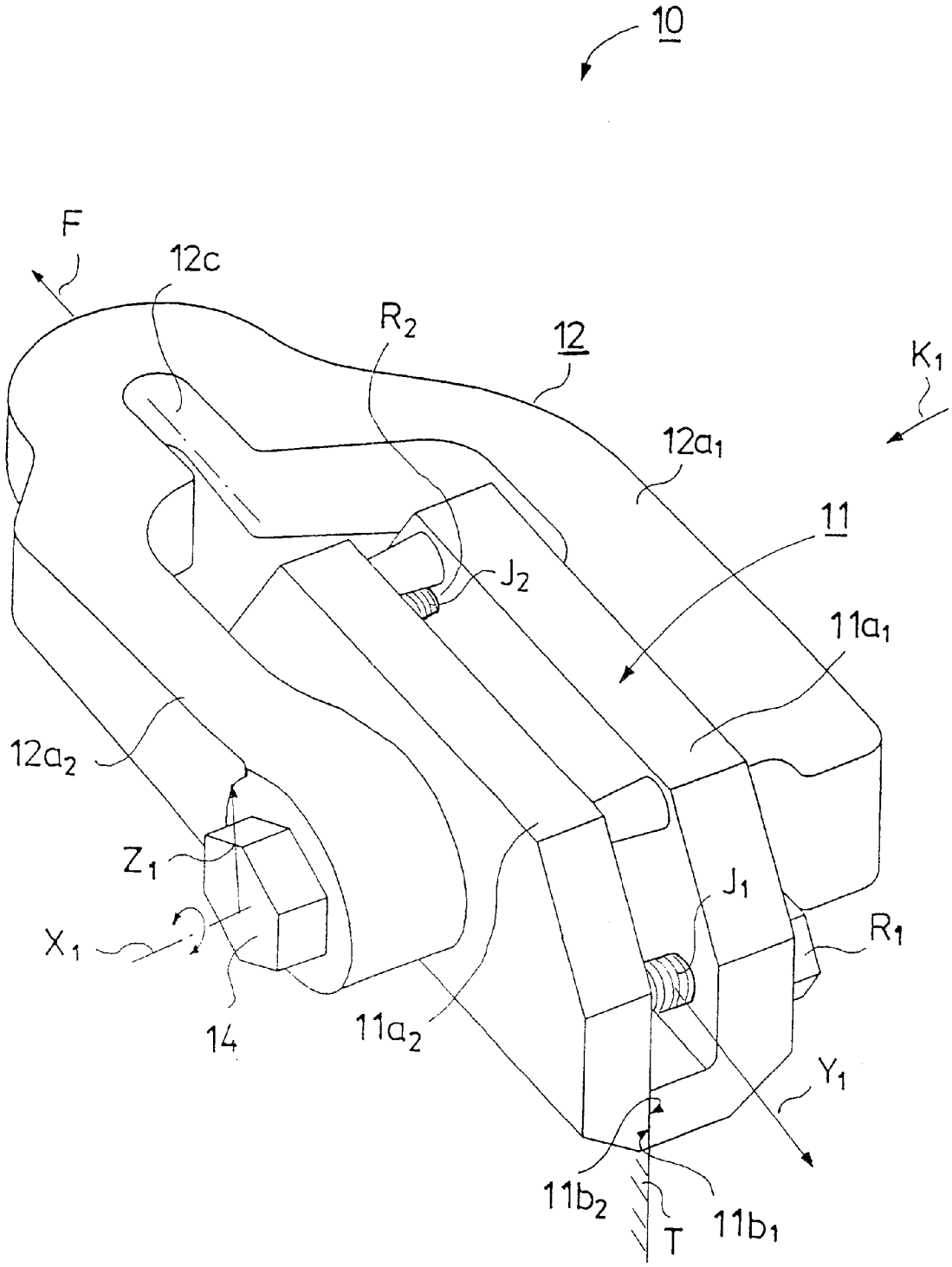
FIG. 1A is perspective view of a gripping device according to the present invention.
Figure 1B:
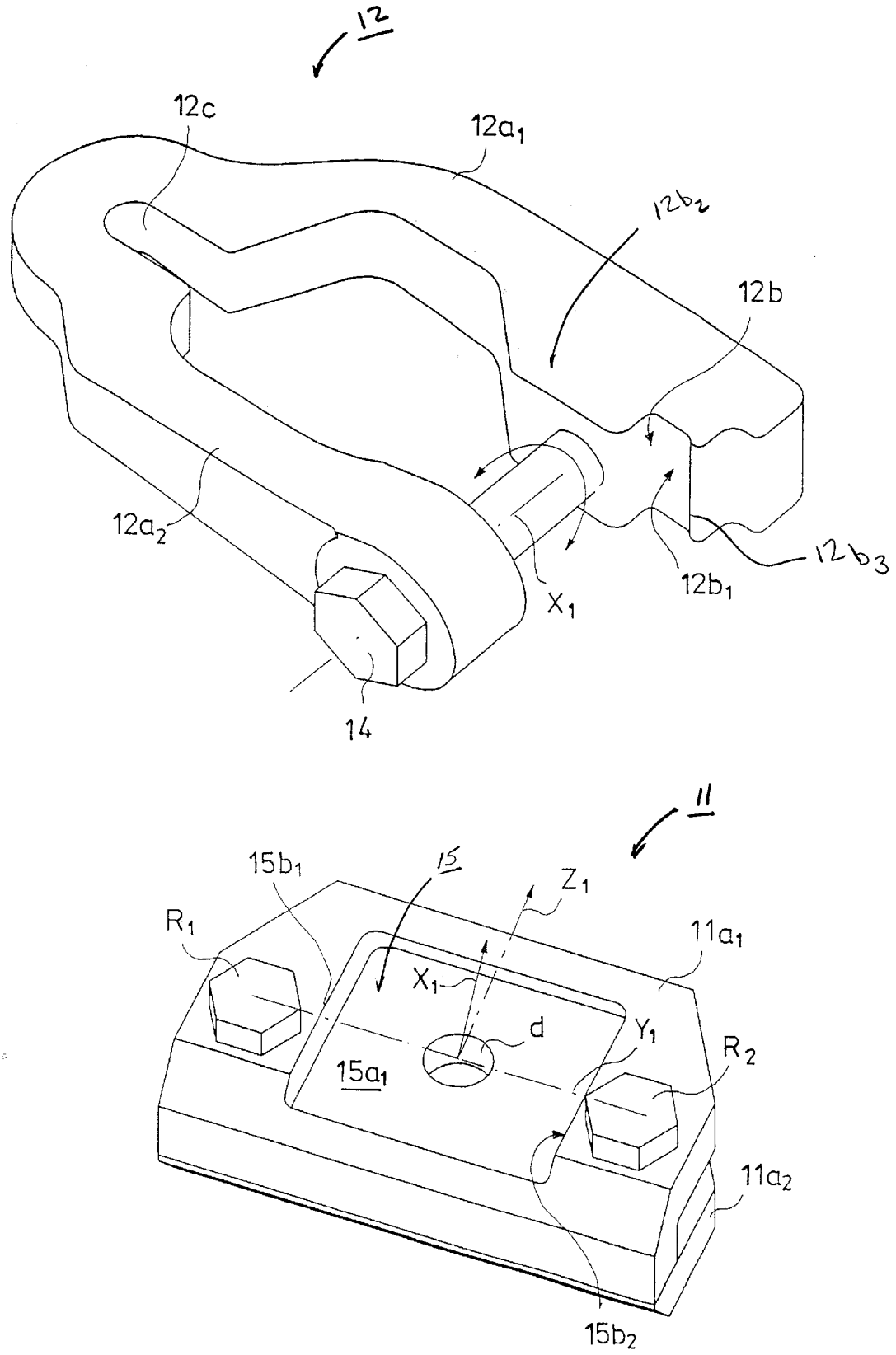
FIG. 1B is an exploded perspective view of the gripping device according to the present invention, wherein the rotatable fastening member is detached from the frame clamping member.

Referring now to the drawings wherein like reference characters designate identical or corresponding features throughout the several views, and more particularly to FIGS. 1A and 1B, a gripping device according to the present invention is generally depicted by the numeral 10.

The gripping device 10 comprises a frame clamping member 11 and a rotatable fastening member 12 pivotably mounted thereon. The frame clamping member 11 comprises a first clamping member $\mathbf{11}a_1$ and a second clamping member $\mathbf{11}a_2$ whereby said clamping members $\mathbf{11}a$and $\mathbf{11}a_2$ are fastened to one another by tightening screws $R_1$ and $R_2$. Preferably, springs $J_1$ and $J_2$ are employed between the clamping members $\mathbf{11}a_1$ and $\mathbf{11}a_2$ around each of the tightening screws $R_1$ and $R_2$ to facilitate the opening and closing of the first and second clamping members $\mathbf{11}a_1$ and $\mathbf{11}a_2$ of the frame clamping member 11. The screws $R_1$ and $R_2$ are located at opposite ends of the clamping members $\mathbf{11}a_1$ and $\mathbf{11}a_2$ and are linearly aligned along line Y1.

The first clamping member $\mathbf{11}a_1$ comprises a gripping claw $\mathbf{11}b_1$ extending perpendicularly from said first clamping member $\mathbf{11}a_1$ and integrally formed along a terminal edge of said first clamping member $\mathbf{11}a_1$ and substantially parallel to line Y1. The first clamping member $\mathbf{11}a_1$ further comprising a rectangular recess 15 formed on an outer surface thereof and defined by a pair of parallel sidewalls 15$b_1$ and 15$b_2$ defining a contact surface 15$a_1$. The second clamping member 11$a_2$ comprises a gripping claw 11$b_2$ formed along a terminal edge of the second clamping member 11$a_2$ and adapted to be aligned with the gripping claw 11$b_1$ of the first clamping member 11$a_1$.

Formed in each of the clamping members 11$a_1$ and 11$a_2$ and aligned with line Y1 is a pair of co-linear holes "d" passing through the recess 15 of the first clamping member 11$a_1$ and through the second clamping member 11$a_2$ (not shown). As shown in FIG. 1A, a gap is formed between the gripping claws 11$b_1$ and 11$b_2$, into which an edge of a sheet of metal corresponding to a location of a vehicle to be repaired is to be disposed.

Figure 3A:
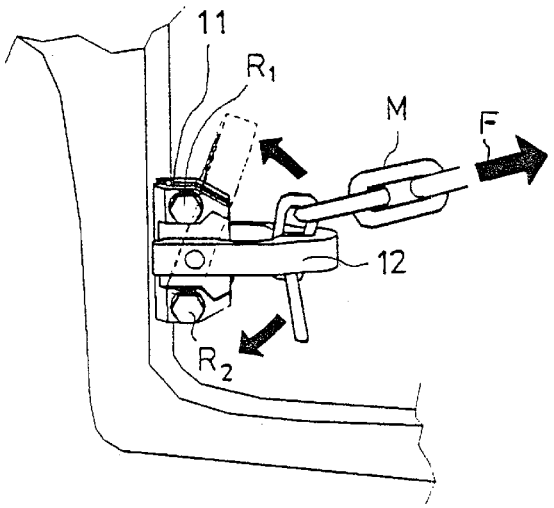
FIGS. 3A and 3B are perspective views illustrating the use of the gripping device in use on the frame of a target repair vehicle, according to the present invention.

The rotatable fastening member 12 is generally Y-shaped and comprises a first arm 12$a_1$ and a second arm 12$a_2$ defining an elongated recess 12$c$ in the end thereof for fastening a chain M and in particular, as seen in FIGS. 3A and 3$b$, a chain link of said chain M. The rotatable fastening member 12 has a longitudinal axis which is located in the same plane T defined by the mating of the first and second clamping members 11$a_1$ and 11$a_2$ when pressed against the edge of the vehicle target being repaired.

The first arm 12$a_1$ comprises a raised region 12$b_2$ integrally formed and extending toward the second arm 12$a_2$. Below the raised region 12$b_2$, in the running direction of the arm 12$a_1$, is a lower region 12$b_1$ defined by a shoulder 12$b$ formed by the raised region 12$b_2$ returning to the width of the first arm 12$a_1$ and a lip 12$b_3$ extending inwardly from a lower end of the first arm 12$a_1$. Formed at a distal end of the second arm 12$a_2$ is a screw hole (not shown) for receiving a link screw 14 therethrough. The raised region 12$b_2$ of the first arm 12$a_1$ being adapted to threadingly receive the link screw 14.

As seen in FIG. 1B, the link screw 14 is located on a rotational axis X1 intersecting the connecting line Y1 between the screws $R_1$ and $R_2$ and a vertical center line Z1 of the frame clamping members 11$a_1$ and 11$a_2$ of the gripping device 11. The rotation axis X1 is rectangular to the plane T formed between the gripping claws 11$b_1$ and 11$b_2$. The vertical center line Z1 and the connecting line Y1 being rectangular to one another.

In operation, the first and second clamping members 11$a_1$ and 11$a_2$ are brought together such that the edge of the vehicle being worked on is engaged therebetween and the screws $R_1$ and $R_2$ are rotatably tightened to thereby clamp the edge of the vehicle between the first and second gripping claws 11$b_1$ and 11$b_2$. Once the gripping claws 11$b_1$ and 11$b_2$ have been tightened to each other, the edge of the vehicle being repaired is located in plane T therebetween.

The rotatable fastening member 12 is then pivotally secured to the frame clamping member 11 such that the raised region 12$b_2$ of the first arm 12$a_1$ contacts the outer surface of the rectangular recess 15 of the first clamping member 11$a_1$ and the inner surface of the second arm 12$a_2$ contacts the outer surface of the second clamping member 11$a_2$. The rotatable fastening member 12 is positioned such that the screw hole located at the distal end of the second arm 12$a_2$ is aligned with hole "d" of the second clamping member 11$a_2$, thereby permitting the link screw 14 to pass through the hole of the second arm 12$a_2$, through both holes "d" of the first and second clamping members 11$a_1$ and 11$a_2$ and to threadingly engage the raised region 12$b_2$ of the second arm 12$a_2$, as seen in FIGS. 1A and 1B. A pull halter, such as a chain, is then removably secured to the rotatable fastening member 12 so that one chain link of the chain M is placed transversely into the recess 12$c$ of the fastening member. The chain M is now, during a pull force, locked relative to the rotatable fastening member 12.

In this manner, as shown in the figures, the rotatable fastening member 12 can be rotated by angle $\alpha$, said angle $\alpha$ being advantageously in the range 0–180°. The rotatable fastening member 12 can therefore be rotated for instance around the rotation axis X1, corresponding to the axis of the link screw 14, into two opposite pull directions, each of which is parallel to the line Y1 between the screws $R_1$ and $R_2$. The straightening force can thereby be applied, e.g. from a straightening cylinder, to the pull halter, e.g. a chain, and further, on to the vehicle itself.

Figure 2A:
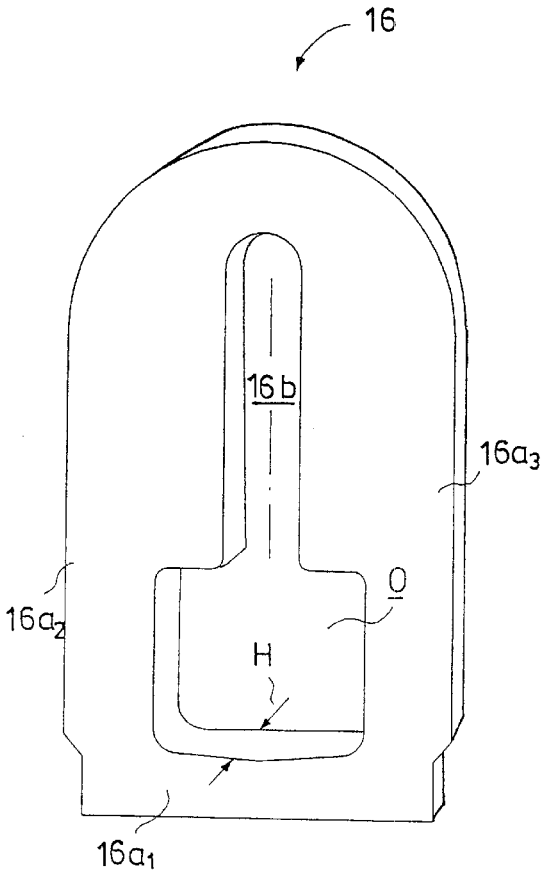
FIG. 2A is a perspective view of a second detachable fastening member according to the present invention, wherein the pulling force to the gripping device is provided rectangularly in relation to the pulling plane of the rotatable fastening member.

FIG. 2A shows a second fastening member 16 which can be used in conjunction with the gripping device 10. The second fastening member 16 is a planar component which can be detachably secured to the gripping device 10 and the rotatable fastening member 12 when the rotatable fastening member 12 is rotated 90° relative to the line Y1, that is, to the center line Z1 of the gripping device 10. The second fastening member 16 comprises a plate having a thickness H, substantially equal to the lower region 12$b_1$ of the first arm 12$a_1$. The second fastening member 16 includes a lower edge 16$a_1$ and side edges 16$a_2$ and 16$a_3$ interconnected at a top part thereof, thereby defining a central cavity O. The cavity O comprises an elongated recess 16$b$ extending into the upper end of the second fastening member 16. In this manner a chain can be fastened to the second fastening member 16 by disposing one chain link transversely relative to is the longitudinal axis of the recess 16$b$ and by taking the subsequent link through the recess 16$b$.

Figure 2B:
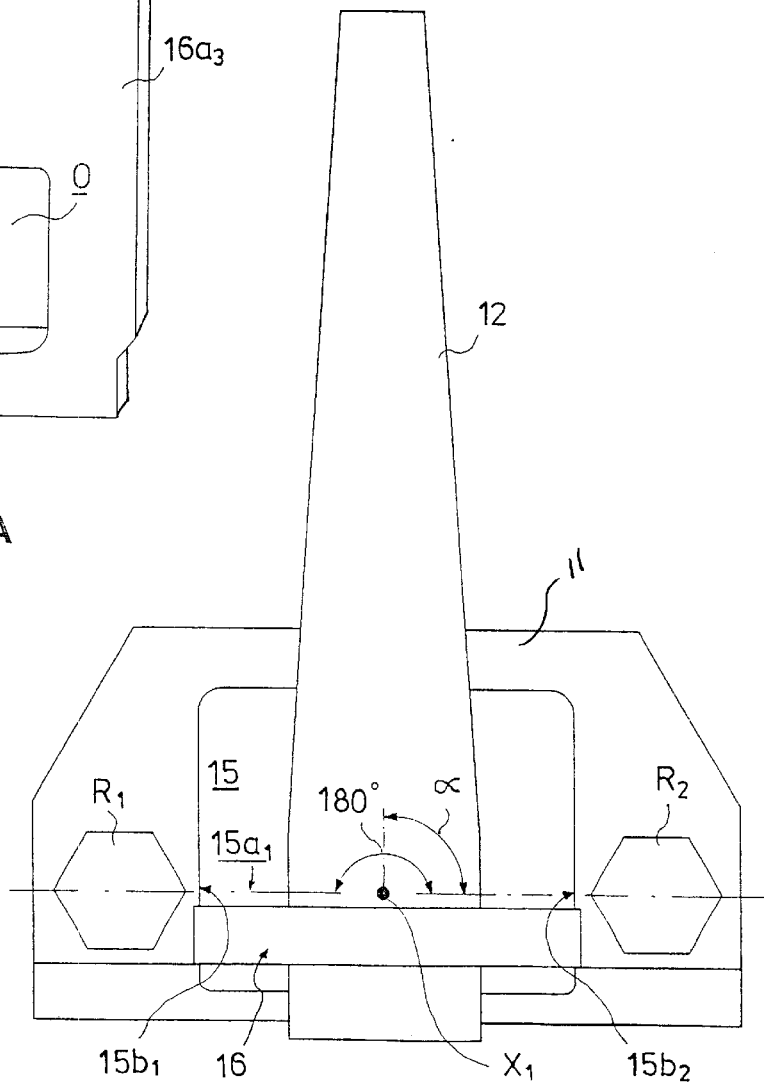
FIG. 2B is an elevational view of a gripping device according to the present invention as seen from the direction of arrow $K_1$ of FIG. 1A; wherein the rotatable fastening member is rotated 90° clockwise from the position shown in FIG. 1A and further showing the second fastening member in place.

FIG. 2B presents a gripping device 10, as seen in the direction of arrow $K_1$ in Figure 1A, with the rotatable fastening member 12 in 90° rotation position (i.e., aligned with line Z1) and with the second fastening member 16 in position. In this arrangement the second fastening member 16 is disposed within the recess 15 of the first clamping member 11$a_1$.

The width of the lower edge 16$a_1$ of the second fastening member 16 is slightly smaller than the width of the recess 15 defined by the side walls 15$b_1$ and 15$b_2$. In this manner, the second fastening member 16 can be seated in the recess 15 between the sidewalls 15$b_1$ and 15$b_2$ and prevented from moving in the Y1 direction. The height and thickness of the lower edge 16$a_1$ of the second fastening member 16 is such that when the lower edge 16$a_1$ is seated in the recess 15, the lip 12$b_3$ of the first arm 12$a_1$ snappingly fits over the lower edge 16$a_1$ and the lower edge 16$a_1$ seats within the lower region 12$b_1$ of the first arm, thereby preventing the second fastening member 16 from moving in the X1 or Z1 directions.

Figure 3B:
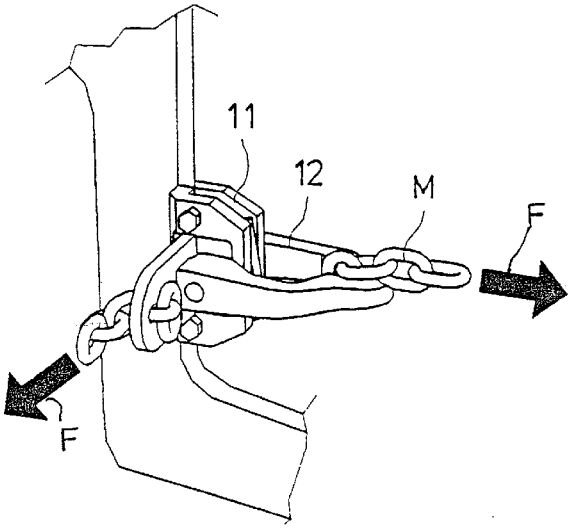

As seen in FIG. 3B, with the aid of said second fastening member 16, the pull force generated in the second fastening member 16 is directed orthogonally to the pull force generated on the first fastening member 12. In other words, the pull direction F generated on the second fastening member 16 and the pulling point for said second fastening member 16 are located such that the pull direction F generated on the second fastening member 16 is orthogonal relative to the plane T defined by the first and second clamping members 11$a_1$ and 11$a_2$. Consequently, no undesired detrimental torques are caused onto the gripping spot.

Figure 3C:
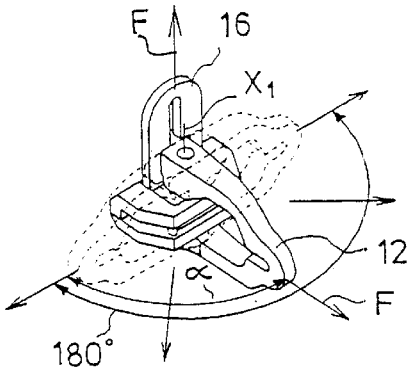
FIG. 3C is an perspective view of the gripping device according to the present invention, demonstrating the diverse pull directions obtainable with the rotatable fastening member and a second fastening member placed in fixed position in relation thereto.

FIGS. 3A, 3B and 3C show the linking of the pull halter, of a chain M as shown in the figures, to the gripping device 10 via the rotatable fastening member 12 and/or the second fastening member 16. The pull F is directed, for instance, from a hydraulic cylinder to a chain M, and further, therethrough to the fastening members 12 and/or 16, and further, to the gripping device 10 and from the gripping device 10 to the target of the vehicle being straightened, via its edge. As seen in FIG. 3C, the pull F on the rotatable fastening member 12 can go through a full 180° angular range of motion due to the pivotable attachment of the rotatable fastening member 12 to the frame part 11.

As taught by the invention, it is advantageous to utilize a linking fastening member 12 of the invention, in which the link point 14 is located in the proximity of the gripping claws or jaws 11$b_1$, 11$b_2$ of the gripping device 10, and it is moreover in the central axis $Z_1$ of the gripping device 10. At this stage, as the straightening is progressing, the frame part 11 rotates relative to the fastening member 12. Therefore, due to the pivotable mounting of the rotatable fastening member 12 to the frame part 11, torque created as a result of the pull F is minimized and the direction of the pull F is always correct relative to the gripping device 10.

Figure 3D:
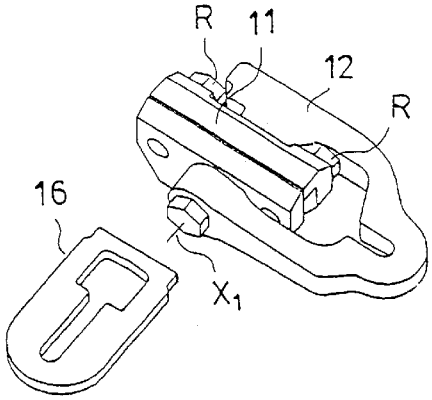
FIG. 3D is an exploded perspective view of the a frame part of the gripping device with the rotatable fastening member and the second fastening member separated therefrom.

FIG. 3D presents a fastening device 10 with rotatable fastening member 12. A second fastening member 16 for a chain M is presented in separation from the assembly.

Numerous modifications and variations of the present invention are possible in light of the teachings hereof. Therefore, it is to be understood that the invention can be varied from the detailed description above within the scope of the claims appended hereto.

What is claimed is:

1. A gripping device (10) for straightening a car body, with the aid of which gripping device (10) a target of a car body to be straightened is gripped and a straightening force is directed at said gripping device with the aid of a pull tool, said gripping device (10) comprising:

gripping claws (11$b_1$, 11$b_2$), which can be positioned around an edge of the target of the vehicle being repaired in order to grip the target, wherein a frame clamping member (11) of the gripping device comprises in association therewith a rotatable fastening member (12) provided for a pull tool, whereto said pull tool such as chain (M) can be fastened to the fastening member (12) and which fastening member (12) is arranged to be rotatable between a rotation angle of 0 to 180° relative to the frame clamping member (11), whereby opposite pull directions are achieved;

a second fastening member (16), wherethrough a pulling force can be directed perpendicularly to the gripping device (11) relative to a pull plane (T) of the rotatable fastening member (12); and wherein said second fastening member (16) is detachably linked to the frame clamping member (11) and seated in a recess (15) formed on the surface of a first gripping device frame part half(11$a_1$), between a side surface (15$a_1$) of the recess (15) and a surface (12$b_1$) of an end shoulder (12$b$) of the rotatable fastening member (12).

2. The gripping device according to claim 1, further comprising:

a link wherein the fastening member (12) is arranged to rotate while supported by said link, said link being located in a connecting line ($Y_1$) between screws ($R_1$, $R_2$) connecting frame part halves (11$_a$, 11$a_2$) of the frame clamping member (11) of the gripping device and located on a center line ($Z_1$) therebetween.

3. The gripping device according to claim 1, wherein the frame clamping member (11) further comprises:

frame part halves (11$a_1$ , 11$a_2$) linked together with the aid of screws ($R_1$, $R_2$) in order to permit movement of the gripping claws (11$b_1$, 11$b_2$) of the frame part halves (11$a_1$, 11$a_2$) towards each other or away from each other.

4. The gripping device according to claim 1, wherein a link is formed from a link screw (14) taken through the gripping device halves (11$a_1$, 11$a_2$) passing through a free hole (d) provided therein, said fastening member (12) comprising arms (12$a_1$, 12$a_2$) positioned around the frame clamp member (11), and said arms (12$a_1$, 12$a_2$) being joined with the link screw (14).

5. The gripping device according to claim 4, wherein an axis ($X_1$) of rotation of the link screw (14) is located in a connecting line ($Y_1$) of the fastening screws ($R_1$, $R_2$) and in addition to a center line ($Z_1$) between said fastening screws ($R_{1,\ R2}$), and that the rotatable axis ($X_1$) is perpendicular to a pull plane (T) of the rotatable fastening member (12).

6. The gripping device according to claim 1, wherein the rotatable fastening member (12) further comprises:

an elongated recess (12$b$) formed in an end thereof for receiving a link of a chain (M), wherethrough the link can be placed and whereacross a second chain link can be placed for locking the chain (M) to the fastening member (12).

7. The gripping device according to claim 1, wherein the second fastening member (16) further comprises:

an elongated recess (16$b$) formed therein, wherethrough a chain link is disposed, whereby the chain is fastened to the second fastening member (16) by placing a link transversely therein relative to the recess (16$b$).

8. A gripping device for straightening a body of a car, the gripping device being structured and arranged to transmit a straightening force from a pull tool to the body of the car to be straightened, the gripping device comprising:

a frame clamping member having a first clamping member and a second clamping member, said first and second clamping members being structured and arranged to grip the body of said car; and a rotatable fastening member pivotably mounted to said frame clamping member, said rotatable fastening member being rotatable between a rotation angle of about 0 to about 180°, said rotatable fastening member comprising pull tool coupling means for coupling a pull tool to said gripping device and for transmitting a pull force from said pull tool to the body of said car;

wherein said first and second clamping members of said frame clamping member are drawn to one another via tightening screws which pass through said first clamping member an threadingly engage said second clamping member, whereby said first clamping member is placed on a first side of said car body, said second clamping member is placed on a second side of said car body and said first clamping member is drawn to said second clamping member by rotating said tightening screws to thereby define a pull plane;

a first and a second arm interconnected to one another and defining an elongated recess, said arms being structured and arranged to be positioned on either side of said frame clamping member, said rotatable fastening member being pivotably attached to said frame clamping member by a link screw passing through a distal end of said first arm, through said first and second clamping members and threadingly engaging a distal end of said second arm, whereby said link screw defines a first axis of rotation of said rotatable fastening member;

a second fastening member, said second fastening member being structured and arranged to transmit a pulling force applied perpendicularly to said second fastening member relative to said pull plane defined by said first and second clamping members;

wherein said first clamping member further comprises a recess formed on an outer surface thereof and defined by a pair of side surfaces, wherein said second fastening member is structured and arranged to be seated within said recess; and wherein said first arm of said rotatable fastening member further comprises a shoulder formed at a distal end of said first arm below the threading engagement of said linking screw, whereby said first arm secures said second fastening member to said clamping member when said linking screw is tightened.

9. The gripping device according to claim 8, wherein the first axis of rotation of said rotatable fastening member intersects a connecting line between said tightening screws and a center line between said tightening screws.

10. The gripping device according to claim 8, wherein said elongated recess is structured and arranged to receive a link of a chain therethrough and wherein a second link of said against said elongated recess to lock said chain within said recess.

11. The gripping device according to claim 8, wherein said second fastening member further comprises:

a pair of side walls interconnected at a top and a bottom thereof, therein defining a cavity; and an elongated recess extending from said cavity toward said top of said second fastening member, whereby said elongated recess of said second fastening member is structured and arranged to transversely receive a link of a second chain therethrough and wherein a second link of said second chain rests transversely across said elongated recess thereby locking said second chain to said second fastening member.

* * * * *